US006473585B2

(12) United States Patent
Abe et al.

(10) Patent No.: US 6,473,585 B2
(45) Date of Patent: Oct. 29, 2002

(54) DEVELOPER ACCOMMODATING CONTAINER, AND DEVELOPING DEVICE

(75) Inventors: Daisuke Abe; Kazuo Chadani, both of Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/758,284

(22) Filed: Jan. 12, 2001

(65) Prior Publication Data

US 2001/0009624 A1 Jul. 26, 2001

(30) Foreign Application Priority Data

Jan. 20, 2000 (JP) ..... 2000-014215

(51) Int. Cl.[7] ..... G03G 15/08; G03G 15/00

(52) U.S. Cl. ..... 399/254; 399/113; 399/281

(58) Field of Search ..... 399/252, 254, 399/256, 236, 113, 119, 120, 281, 111; 222/DIG. 1; 366/241, 292, 297

(56) References Cited

U.S. PATENT DOCUMENTS

| | | | | | |
|---|---|---|---|---|---|
| 4,777,512 | A | * | 10/1988 | Takahashi et al. | 399/254 X |
| 5,450,166 | A | * | 9/1995 | Yashiro | 399/111 |
| 5,826,132 | A | * | 10/1998 | Damji et al. | 399/111 X |
| 5,857,134 | A | * | 1/1999 | Ahn | 399/256 |
| 5,943,529 | A | | 8/1999 | Miyabe et al. | 399/111 |
| 5,943,537 | A | * | 8/1999 | Ahn | 399/254 |
| 5,966,567 | A | | 10/1999 | Matsuzaki et al. | 399/111 |
| 6,144,815 | A | | 11/2000 | Chadani et al. | 399/27 |
| 6,144,829 | A | * | 11/2000 | Miyasaka et al. | 399/281 |
| 6,173,140 | B1 | | 1/2001 | Suzuki et al. | 399/113 |
| 6,173,145 | B1 | | 1/2001 | Chadani et al. | 399/265 |
| 6,178,302 | B1 | | 1/2001 | Nagashima et al. | 399/106 |
| 6,226,484 | B1 | * | 5/2001 | Ichikawa et al. | 399/281 |
| 2002/0051653 | A1 | * | 5/2002 | Toba et al. | 399/111 |

FOREIGN PATENT DOCUMENTS

| | | | |
|---|---|---|---|
| JP | 04-115269 | * | 4/1992 |
| JP | 04-140774 | * | 5/1992 |
| JP | 04-330471 | * | 11/1992 |
| JP | 07-005756 | * | 1/1995 |
| JP | 08-062958 | * | 3/1996 |

* cited by examiner

*Primary Examiner*—Sophia S. Chen
(74) *Attorney, Agent, or Firm*—Fitzpatrick, Cella, Harper & Scinto

(57) ABSTRACT

A developer accommodating container accommodates a developer. A developing container where the developer is supplied from the developer accommodating container is swingably connected to the developer accommodating container. The developer accommodating container includes a developer accommodating portion for accommodating the developer, and a plurality of rotatable conveying members, provided in the developer accommodating portion, for conveying the developer. The plurality of conveying members includes a first conveying member, provided at a portion closest to the developing container, for conveying the developer to the developing container. The first conveying member out of the plurality of conveying members has a largest angular velocity and a smallest radius of rotation.

22 Claims, 9 Drawing Sheets

DEVELOPER ACCOMMODATING CONTAINER, AND DEVELOPING DEVICE

BACKGROUND OF THE INVENTION

1. Field of the Invention

The present invention relates to a developer accommodating container and a developing device, which are suitably used in a process cartridge or an electrophotographic image forming apparatus.

2. Description of the Related Art

Recently, a process cartridge method has been widely adopted in which in an image forming apparatus using an electrophotographic image forming process, an electrophotographic photosensitive member, serving as an image bearing member, and process means operating thereon are integrated to provide a cartridge so as to be detachable with respect to the main body of the image forming apparatus.

Such a conventional process cartridge includes a developing container, a toner accommodating container, serving as a developer accommodating container, and a cleaning container, and a toner is supplied from the toner accommodating container to the developing container by the fall of the toner stirred by a stirring member due to the toner's own weight.

However, the conventional process cartridge has the following problems.

That is, if the size of the toner accommodating container is increased, the circulation of the toner is degraded due to an increase in the weight of the toner, resulting, for example, in severer developing conditions.

Furthermore, when the size of the toner accommodating container is increased, if the configuration that a developing container and the toner accommodating container are swingably pressed against each other in order to position a developer carrying member provided in the developing container with respect to a photosensitive member is adopted, a change in the weight of a toner within the toner accommodating container sometimes influences the pressure between the photosensitive member and the developer carrying member.

SUMMARY OF THE INVENTION

It is an object of the present invention to provide a developer accommodating container and a developing device which allow an increase in the size of the developer accommodating container.

It is another object of the present invention to provide a developer accommodating container and a developing device including the same which can improve the picture quality by improving the circulation of a developer, preventing degradation of the developer accommodating container and the developing device, and stably supplying the toner, while realizing an increase in the size of the developer accommodating container.

It is still another object of the present invention to provide a developer accommodating container and a developing device in which a change in the amount of a developer remaining in the developer accommodating container does not influence positioning between a developer carrying member and an image bearing member, while realizing an increase in the size of the developer accommodating container.

According to one aspect, the present invention which achieves these objectives relates to a developer accommodating container for accommodating a developer. A developing container where the developer is supplied from the developer accommodating container is swingably connected to the developer accommodating container. The developer accommodating container includes a developer accommodating portion for accommodating the developer, and a plurality of rotatable conveying members, provided in the developer accommodating portion, for conveying the developer. The plurality of conveying members include a first conveying member, provided at a portion closest to the developing container, for conveying the developer to the developing container. The first conveying member out of the plurality of conveying members has a largest angular velocity and a smallest radius of rotation.

According to another aspect, the present invention which achieves these objectives relates to a developing device including a developer accommodating container for accommodating a developer, and a developing container where the developer is supplied from the developer accommodating container. The developing container is swingably connected to the developer accommodating container. The developer accommodating container includes a developer accommodating portion for accommodating the developer, and a plurality of rotatable conveying members, provided in the developer accommodating portion, for conveying the developer. The plurality of conveying members include a first conveying member, provided at a portion closest to the developing container, for conveying the developer to the developing container. The first conveying member out of the plurality of conveying m embers has a largest angular velocity and a smallest radius of rotation.

The foregoing and other objects, advantages and features of the present invention will become more apparent from the following detailed description of the preferred embodiment taken in conjunction with the accompanying drawings.

DETAILED DESCRIPTION OF THE PREFERRED EMBODIMENT

A preferred embodiment of the present invention will now be described with reference to the drawings.

Figure 1:
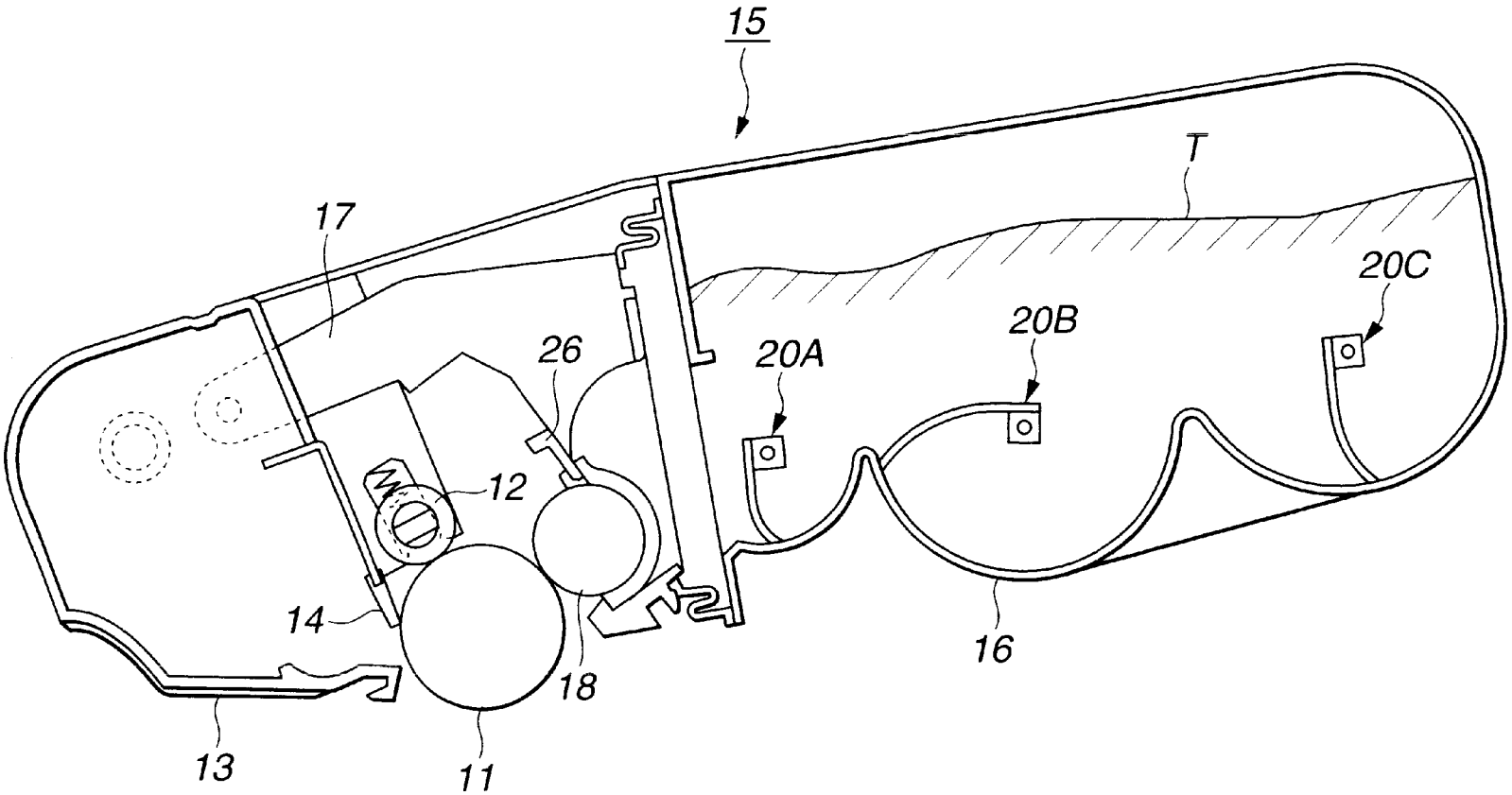
FIG. 1 is a cross-sectional view of a process cartridge according to an embodiment of the present invention.
Figure 2:
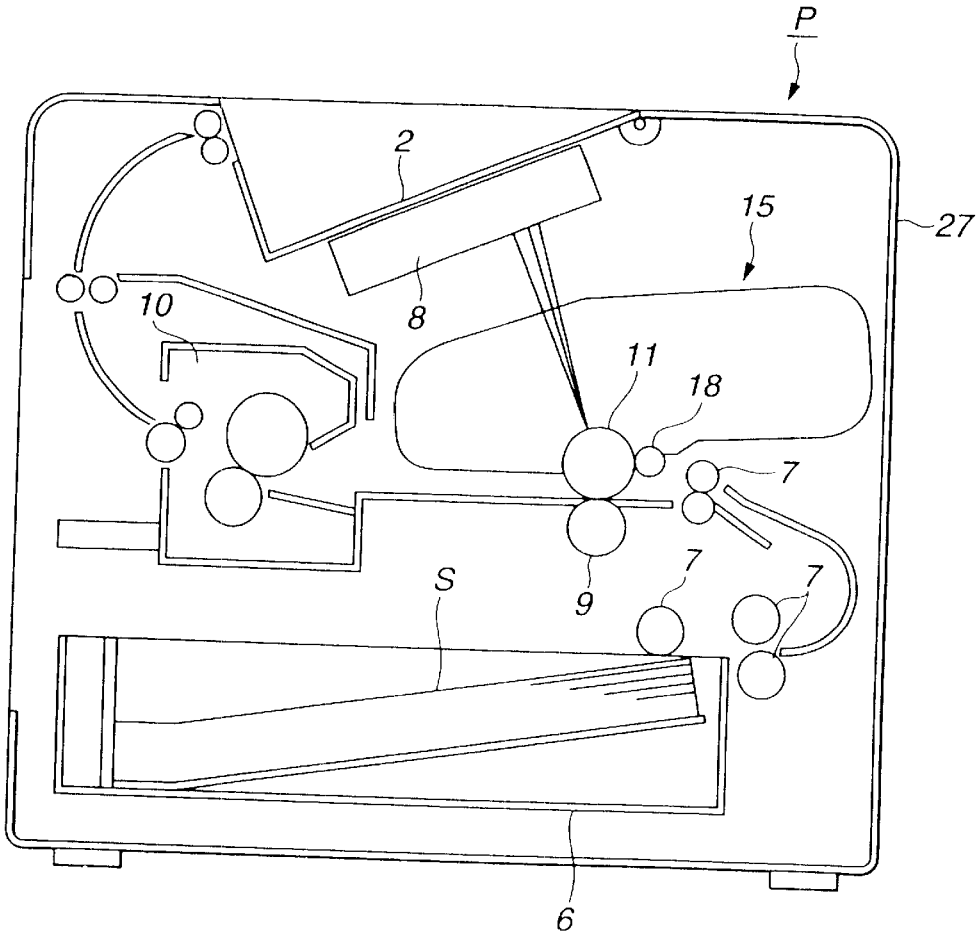
FIG. 2 is a cross-sectional view of an electrophotographic image forming apparatus according to the embodiment.

Description of a Process Cartridge and a Main Body of an Image Forming Apparatus FIG. 1 is a cross-sectional view illustrating a process cartridge according to the embodiment. FIG. 2 is a cross-sectional view illustrating an electrophotographic image forming apparatus according to the embodiment.

In FIG. 1, a process cartridge 15 is detachable with respect to the main body of an image forming apparatus, and includes a photosensitive drum 11, serving as an image bearing member, and various process means operating thereon. The process means include, for example, a charging roller 12 for charging the surface of the photosensitive drum 11, a developing device for forming a toner image by a developing sleeve 18, serving as a developer carrying member, and a cleaning device for removing toner particles remaining on the surface of the photosensitive drum 11. The process cartridge 15 may include the photosensitive drum 11 and at least one of the process means.

First, an image forming procedure will be described with reference to FIGS. 1 and 2.

As shown in FIG. 1, the process cartridge 15 of the embodiment includes the charging roller 12, serving as charging means, a developing container 43, serving as the developing device, a toner accommodating container 16 and a cleaning blade 14, serving as cleaning means, around the electrophotographic photosensitive drum 11. These units are integrally covered with a housing. The process cartridge 15 is detachable with respect to a main body 27 of an image forming apparatus P (see FIG. 2). The developing container 43 includes the developing sleeve 18 and a developing blade 26. The toner accommodating container 16 includes stirring members 20A–20C for stirring and conveying a toner.

The process cartridge 15 is used for image formation in a state of being mounted in the main body 27 of the electrophotographic image forming apparatus P as shown in FIG. 2. In image formation, a sheet S is conveyed by conveying rollers 7 from a sheet cassette 6 mounted at a lower portion of the apparatus. An electrostatic latent image is formed on the photosensitive drum 11 by performing selective exposure on the photosensitive drum 11 from an exposure apparatus 8 in synchronization with the conveyance of the sheet S. Then, a toner T accommodated in the toner accommodating container 16 is sent to the developing container 17. A thin layer of the toner T is carried on the surface of the developing sleeve 18 by the developing blade 26. The toner T is supplied from the developing sleeve 18 onto the photosensitive drum 11 in accordance with the electrostatic latent image by applying a developing bias voltage to the developing sleeve 18. Thus, the electrostatic latent image on the photosensitive drum 11 is developed to visualize the image as a toner image.

Then, the toner image formed on the photosensitive drum 11 is transferred onto the sheet S by applying a bias voltage to a transfer roller 9 at a transfer position. The sheet S having the toner image transferred thereon is conveyed to a fixing unit 10 to fix the toner image on the sheet S. The sheet S having the fixed toner image thereon is discharged onto a discharging unit 2 provided at an upper portion of the apparatus. Toner particles remaining on the photosensitive drum 11 after the transfer of the toner image are removed by the cleaning blade 14, and moved to a rear portion of a cleaning container 13.

Configuration of the Frame of the Process Cartridge

Figure 3:
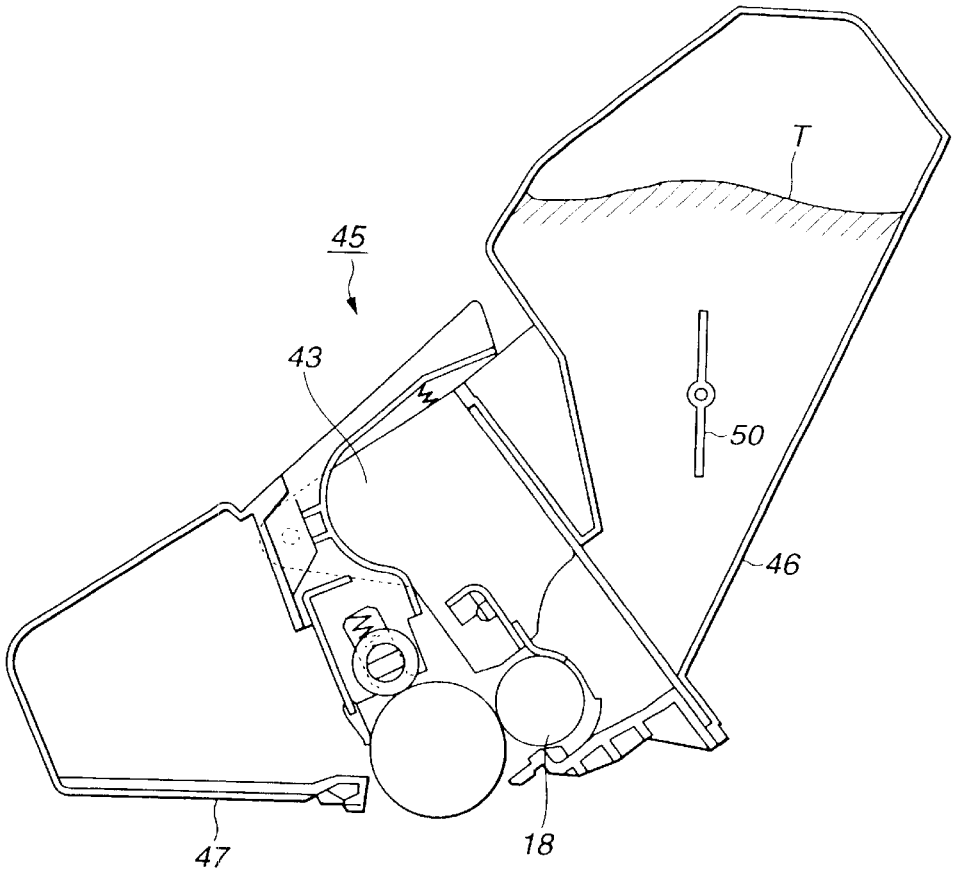
FIG.3 PRIOR ART
FIG. 3 is a cross-sectional view of a conventional process cartridge.

FIG. 3 illustrates a cross section of a conventional process cartridge 45. The conventional process cartridge 45 also includes a developing container 43, a toner accommodating container 46, a cleaning container 47, and the like. The process cartridge 45 is detachably mounted in the main body of an image forming apparatus.

In the toner accommodating container 46, the developing container 43 holding a developing sleeve 18 is fixed, and a toner stirring member 50 is rotatably fixed. The developing sleeve 18 and the stirring member 50 are rotatably driven by a driving force from the main body of the image forming apparatus. The toner accommodating container 46 and the developing container 43 are positioned at predetermined positions with respect to the main body of the image forming apparatus. The base of the toner accommodating container 46 is inclined, so that a toner T falls by its own weight in accordance with consumption of the toner T by development, and is supplied into the developing container 43. By stirring toner particles at a lower portion of the toner accommodating container 46 by the stirring member 50, the toner T further tends to fall.

In such a configuration of the toner accommodating container 46, if it is intended to increase the amount of the toner T, the toner T is more strongly pushed into the developing container 43 in proportion to an increase in the weight of the toner T. As a result, problems may arise such that fading, degradation of the toner T itself, an increase in the torque during tapping, and the like occur due to an increase in the weight of the toner T, resulting, for example, in severer developing conditions, and necessity to increase the strength of components. Furthermore, the toner accommodating container 46 and the developing container 43 are fixed in a state of integrally swingable with respect to a photosensitive member. Hence, if the amount of the toner T is increased, a change in the weight of the toner T within the toner accommodating container 46 influences the pressure between the photosensitive member and the developing sleeve 18.

Figure 4:
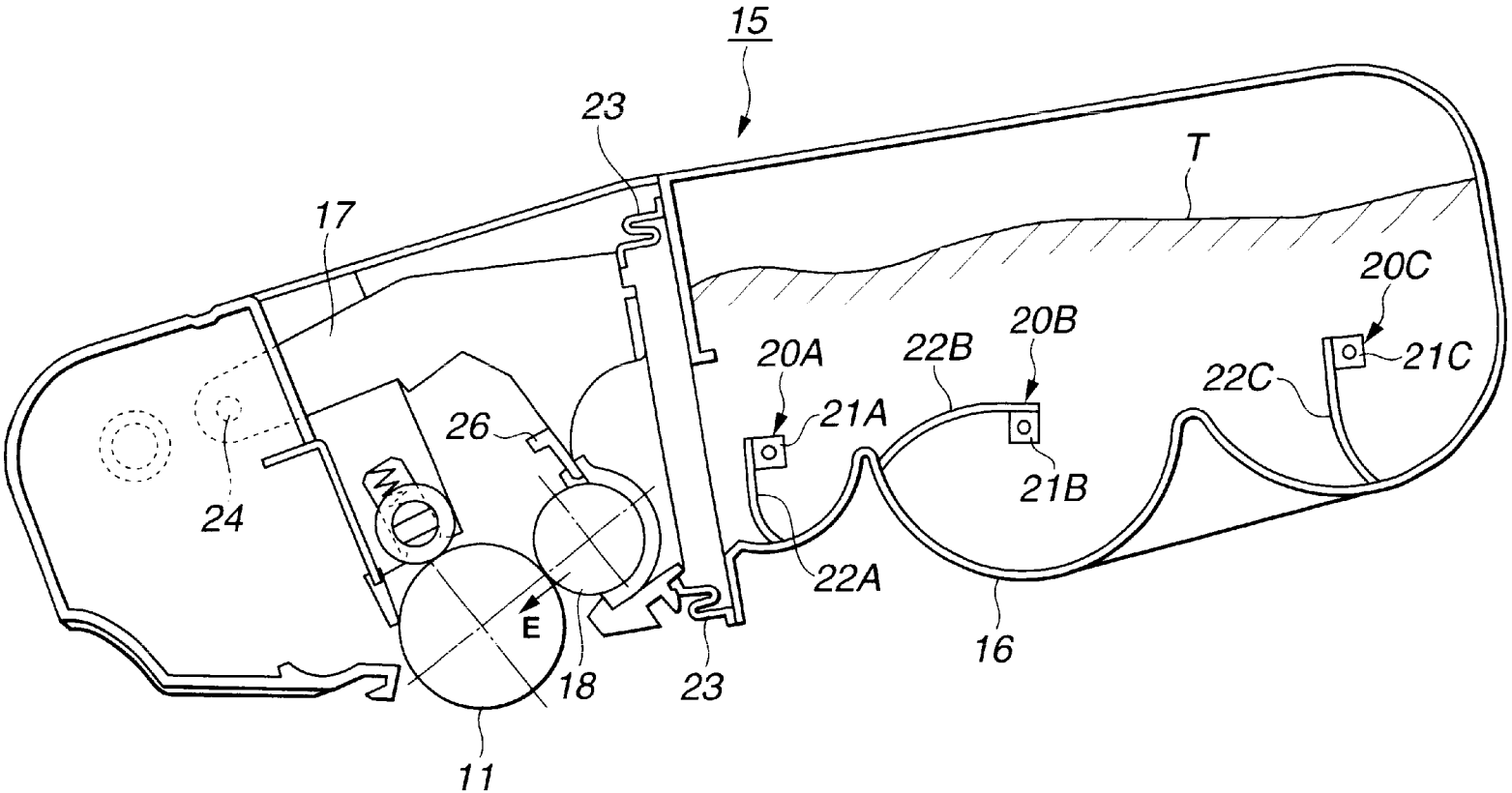
FIG. 4 is a cross-sectional view of the process cartridge indicating a toner accommodating container according to the embodiment.

FIG. 4 is a cross-sectional view of the toner accommodating container 16 according to the embodiment.

The toner accommodating container 16 incorporates stirring members 20A–20C for conveying and stirring the toner T, and the toner T. The stirring members 20A–20C are configured by fixing stirring wing members 22A–22C to rotating bar members 21A–21C, respectively. By the rotation of the stirring members 20A–20C, the toner T is conveyed and stirred. Although in this embodiment, the three stirring members 20A–20C are provided, the number of stirring members may be increased in accordance with the size of the toner accommodating container 16. The rotating bar members 21A–21C are rotatably supported in the toner accommodating container 16, and are rotated by being driven from the main body of the apparatus via gear members (not shown) connected corresponding ones of the rotating bar members 21A–21C.

The developing container 17 is not fixed to the toner accommodating container 16. That is, although the toner accommodating container 16 is positioned and supported on the main body 27 of the image forming apparatus, the developing container 17 is swingable with respect to the main body 27 of the image forming apparatus. The developing container 17 is pressed in a direction E connecting the center of the photosensitive drum 11 and the center of the developing sleeve 18 around a swinging fulcrum 24 by an elastic member (not shown), such as a spring or the like. Since the developing container 17 is swingably supported so as to follow the photosensitive drum 11, a change in the weight of the toner accommodating container 16 does no influence the pressure between the photosensitive drum 11 and the developing sleeve 18. Accordingly, problems in the formed image due to the weight of the toner do not arise. A sheet member 23 is used in order to seal the gap between the toner accommodating container 16 and the developing container 17. The seal member 23 connects the toner accommodating container 16 and the developing container 17 to each other in the form of bellows, and do not hinder the swing of the developing container 17.

The developing member 17 does not include stirring members. That is, only the developing sleeve 18 operates as a toner conveying member provided in the developing container 17. Accordingly, by reducing the size of the developing container 17, the stirring member 20A provided within the toner accommodating container 16 is caused to operate on the toner T within the developing container 17. If a stirring member is provided within the developing container 17, it is difficult to provide a driving transmission member for transmitting a driving force from the main body of the image forming apparatus to the stirring member because the developing container 17 is swingable. Accordingly, it is preferable not to provide a stirring member in the developing container 17.

FIGS. 5–8 are cross-sectional views, each illustrating a state of consumption of the toner T.

Figure 5:
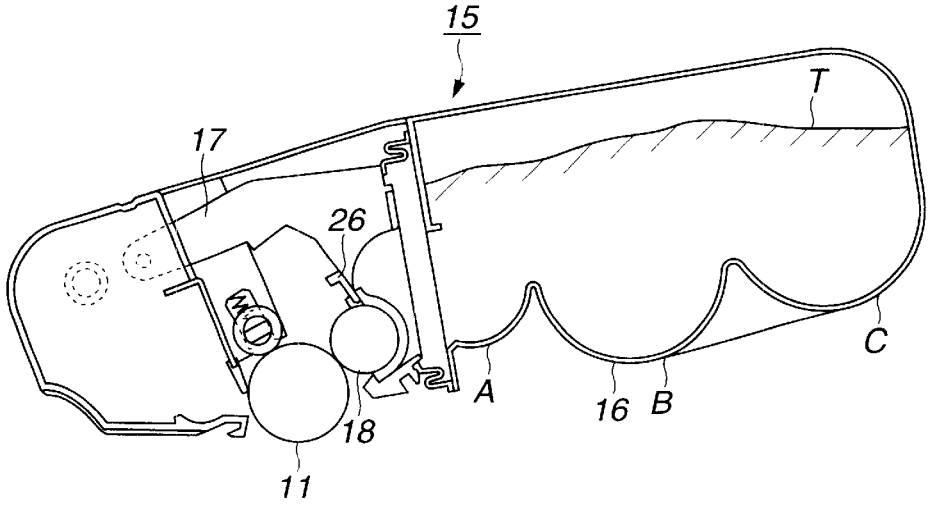
FIGS. 5–8 are cross-sectional views of the process cartridge, each indicating a state of toner consumption in the toner accommodating container according to the embodiment.
Figure 6:
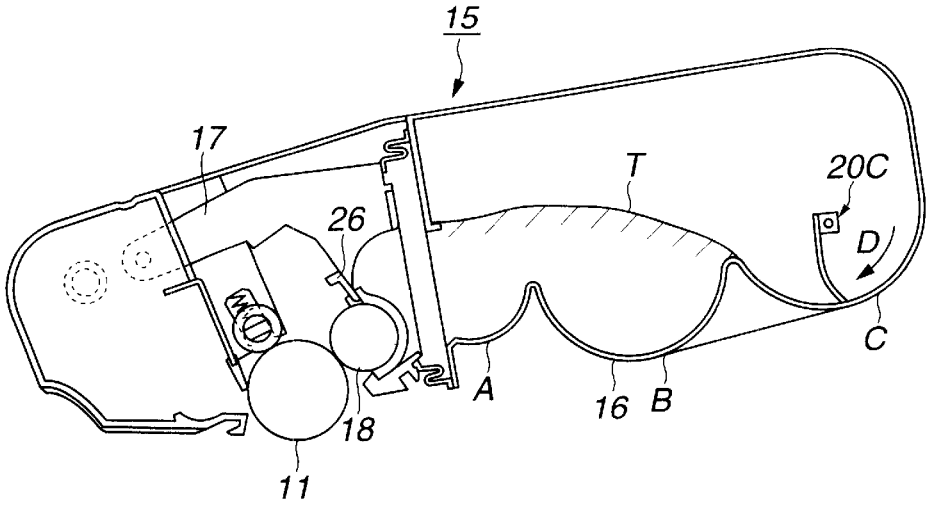
Figure 7:
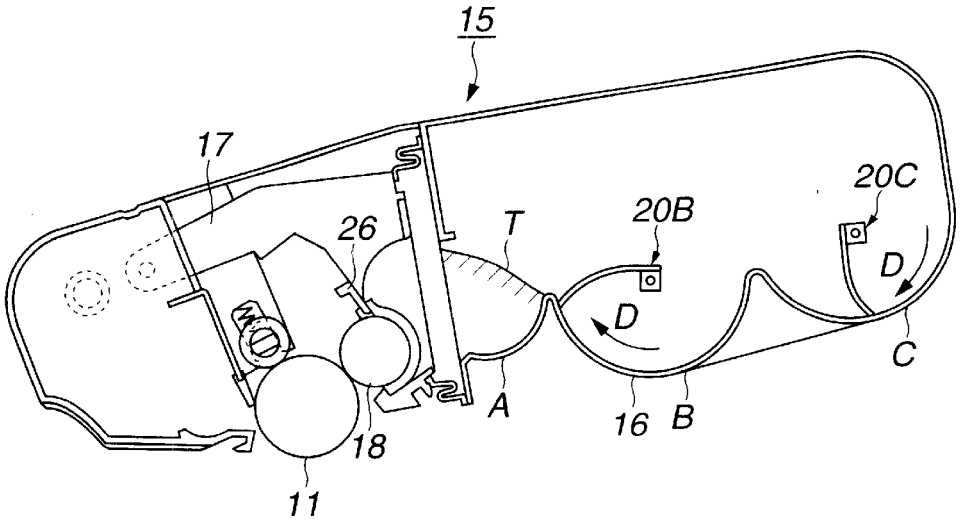
Figure 8:
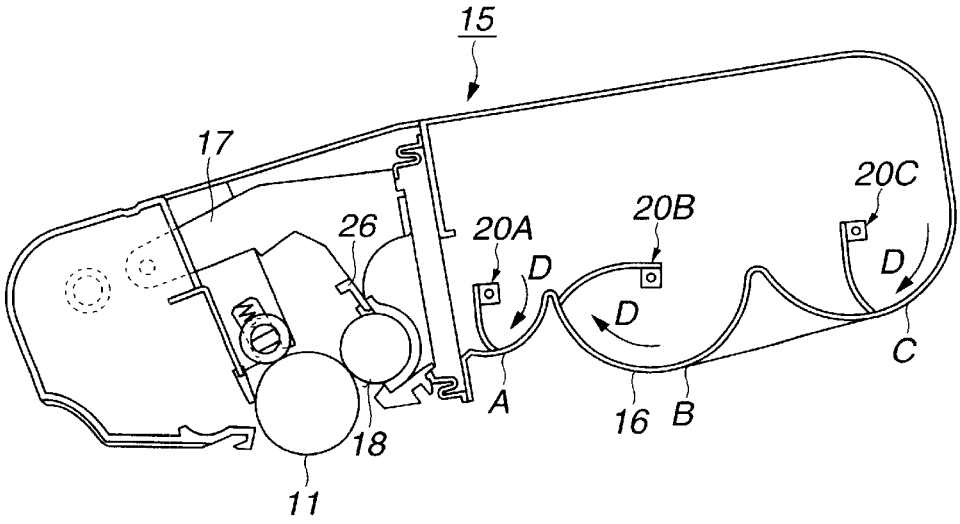

As shown in FIGS. 5–8, three recesses A, B and C are provided in this sequence from a portion closer to the developing container 17 at the base. of a toner accommodating portion of the toner accommodating container 16. FIG. 5 illustrates a state in which the toner T is not consumed at all. FIG. 6 illustrates a state in which the toner T is absent in the recess C after being consumed. FIG. 7 illustrates a state in which the toner T is also absent in the recess B after being further consumed. FIG. 8 illustrates a state in which the toner T is entirely consumed. The stirring members 20A–20C rotate in the direction of an arrow D shown in FIGS. 5–8, and push and convey the toner T by the stirring wing members 22A–22C, respectively. While the toner T is consumed in the developing container 17, new particles of the toner T are conveyed into the developing container 17 by the stirring members 20A–20C. Hence, the toner T gradually disappears from the toner accommodating container 16 starting from the most remote recess C.

By providing the plurality of stirring members 20A–20C in the above-described manner, it is possible to increase the surface area of the toner accommodating container 16 by providing a substantially long and flat shape, without inclining the toner accommodating container 16. As a result, the weight of the toner T is dispersed, and it is possible to prevent fading, degradation of the toner T itself, and an increase in the torque during tapping due to the weight of the toner T.

Figure 9:
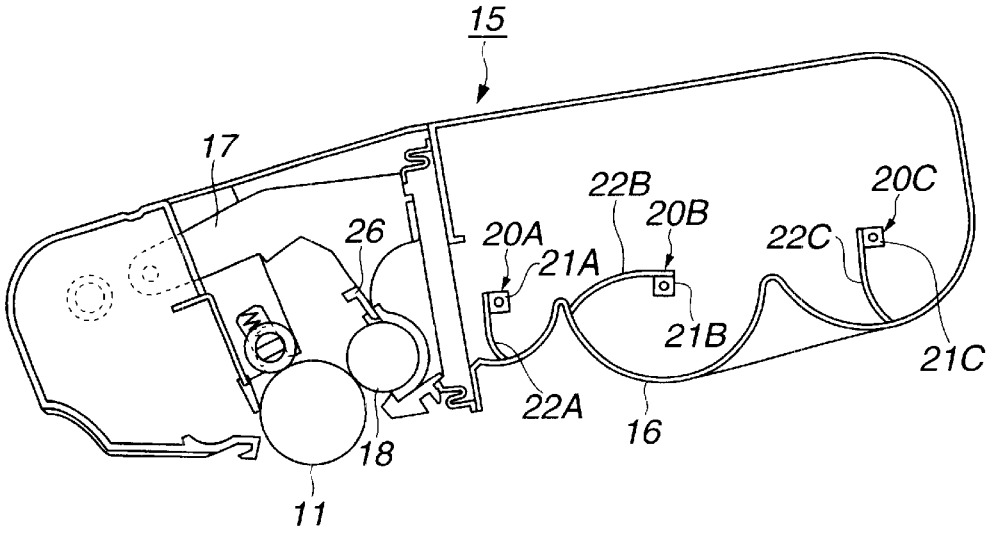
FIG. 9 is a cross-sectional view of the process cartridge indicating the toner accommodating container according to the embodiment.
Figure 10:
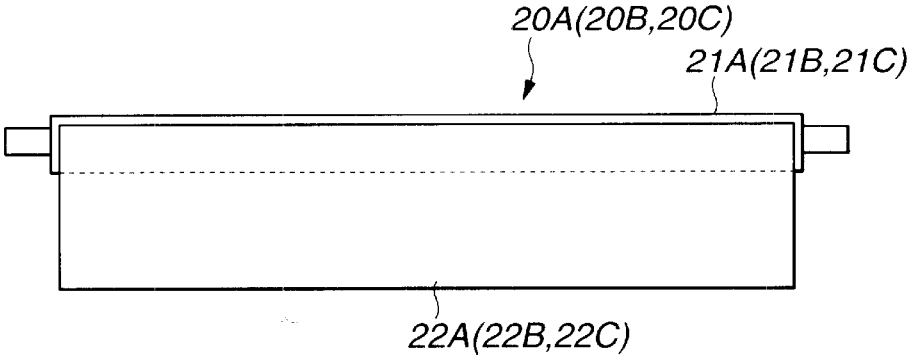
FIG. 10 is a front view of a stirring member provided in the toner accommodating container according to the embodiment.
Figure 11:
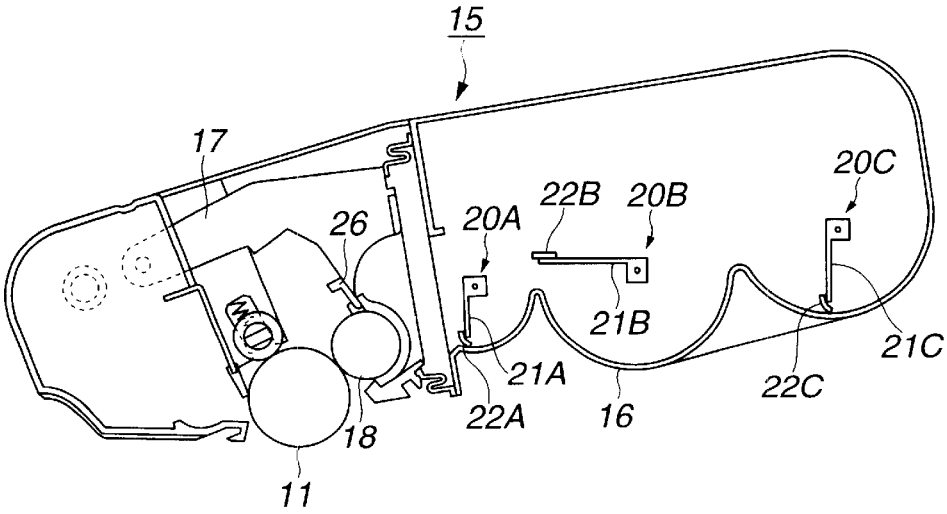
FIG. 11 is a cross-sectional view of the process cartridge indicating the toner accommodating container according to the embodiment.
Figure 12:
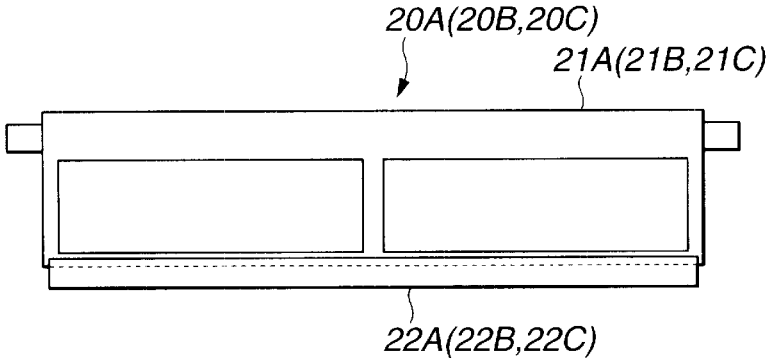
FIG. 12 is a front view of a stirring member provided in the toner accommodating container according to the embodiment.

Next, a description will be provided of the configuration of the stirring members 20A–20C with reference to FIGS. 9–12. FIGS. 9 and 11 are cross-sectional views of the toner accommodating container 16, and. FIGS. 10 and 12 are front views of the stirring members 20A–20C.

As described above, the stirring members 20A–20C are configured by the rotating bar members 21A–21C, and stirring wing members 22A–22C, respectively. Each of the rotating bar members 21A–21C and the stirring wing members 22A–22C is fixed to each other by means of screwing, bonding, thermal calking or the like.

In FIGS. 9 and 10, elastic resin sheet members, for example, made of polyethylene terephthalate or the like, are used as the stirring wing members 22A–22C. However, as shown in FIGS. 11 and 12, the stirring members 20A–20C may be configured by fixing stirring wing members 22A–22C comprising elastic sheet members on corresponding distal ends of ladder-shaped stirring bar members 21A–21C, respectively. In this case, the radius of rotation of the distal end of each of the stirring wing members 22A–22C is slightly longer than the radius of the circular arc of the corresponding recess of the base of the toner accommodating container 16. Hence, even when the amount of remaining particles of the toner T becomes small, the distal ends of the stirring wing members 22A–22C move while strongly contacting the base of the toner accommodating container 16, to scrape toner particles remaining at the base of the toner accommodating container 16.

Figure 13:
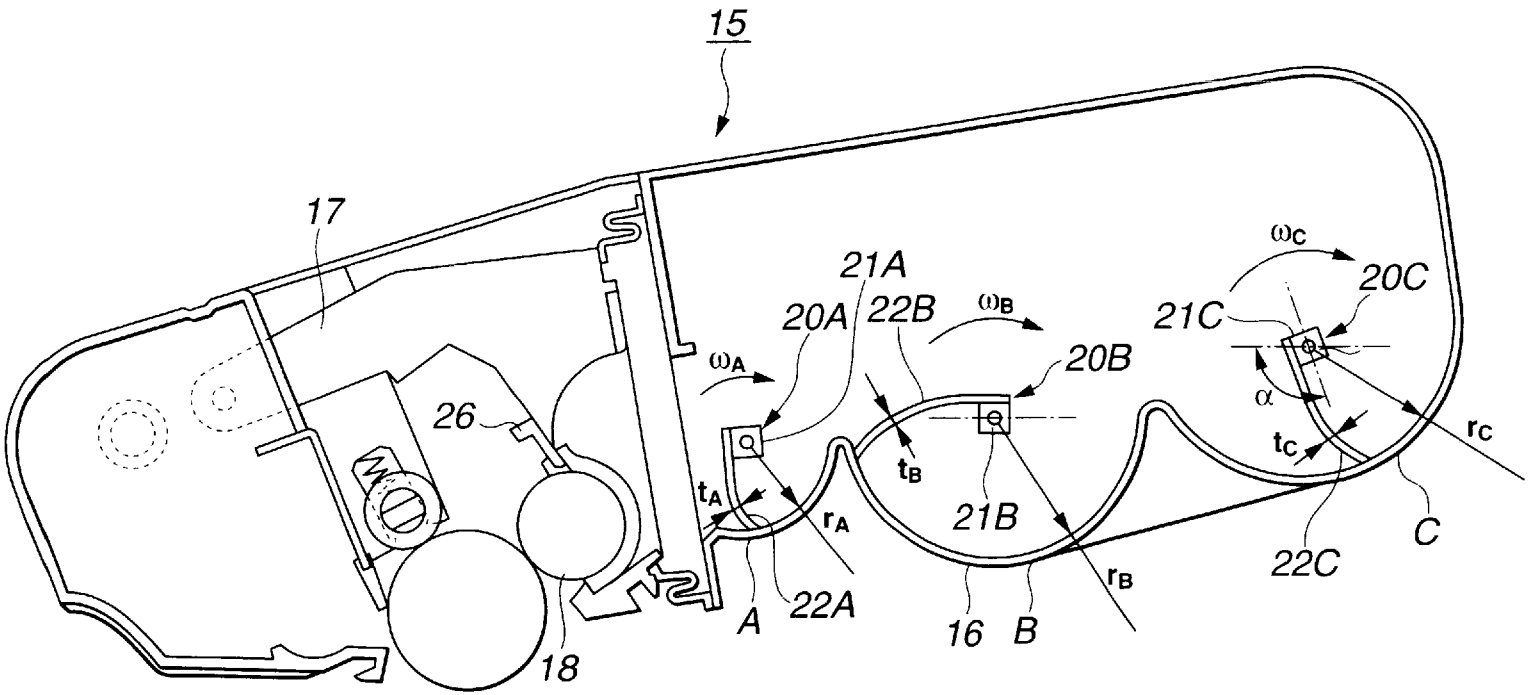
FIG. 13 is a cross-sectional view of the process cartridge indicating the toner accommodating container according to the embodiment.

FIG. 13 is a cross-sectional view of the process cartridge 15 according to the embodiment. Conditions and effects of the plurality of stirring members 20A–20C will now be described.

The stirring members 20A–20C are rotatably driven by a driving mechanism (not shown) of the main body of the image forming apparatus. The rotational angular velocities of the stirring members 20A–20C differ from one another according to a gear arrangement of driving transmission. More specifically, if the stirring speeds (angular velocities) of the stirring members 20A, 20B and 20C are represented by $\omega_A$, $\omega_B$ and $\omega_C$, respectively, these speeds are arranged to have a relationship of $\omega_A>\omega_B=\omega_C$. It is preferable, for example, that $\omega_B$ equals $\omega_C$, and $\omega_A$ is about 2–10 times $\omega_B$ and $\omega_C$. Thus, it is possible to facilitate the circulation of the toner T near the developing sleeve 18, and prevent degradation of the toner T due to excessive stirring at a portion remote from the developing sleeve 18.

The radii of the recesses A, B and C at the base of the toner accommodating container 16 also differ from one another. In FIG. 13, if the radii of the recesses A, B and C are represented by $r_A$, $r_B$ and $r_C$, respectively, a relationship of $r_A<r_B=r_C$ holds, and the same relationship holds for the radii of rotation of the distal ends of the stirring wing members 22A, 22B and 22C. By reducing the radius $r_A$ and the radius of the distal end of the stirring wing member 22A, it is possible to prevent conveyance of the toner T whose amount is more than necessary, and stably supply the toner T. If the radii $r_B$ and $r_C$ are much smaller than the size of the toner accommodating container 16, the number of the stirring members must be increased. By providing appropriate values for these radii, it is possible to reduce the number of stirring members, and reduce the cost.

The thicknesses of the elastic sheet members used as the stirring members 22A–22C also differ from one another. If the thicknesses of the stirring members 22A, 22B and 22C are represented by $t_A$, $t_B$ and $t_C$, respectively, a relationship of $t_A<t_B=t_C$ holds. It is preferable that $t_A$ is within a range of about 38–75 $\mu$m, and $t_B$ and $t_C$ are within a range of about 75–188 $\mu$m. According to this configuration, since the modulus of elasticity of the stirring wing member 22A is small at the recess A, the stirring wing member 22A bends when the amount of the toner T is large, so that the toner T is supplied to the developing sleeve 18 by the toner's own weight. Even when the amount of the toner T decreases, the toner T is supplied with a small repulsive force. At the recesses B and C, since the toner T must be drawn when supplying the toner T, the conveying force for the toner T is obtained by using a sheet member thicker than at the recess A.

Since the rotational angular velocities $\omega_B$ and $\omega_C$ equal at the stirring members 20B and 20C, the phase relationship in the initial state is always maintained. It is only necessary that the recesses B and C do not have the same phase. If the phase difference between the stirring members 22B and 22C is represented by $\alpha$, it is preferable that $90° < \alpha < 270°$. By providing such a phase difference, the stirring torque during conveyance of the toner is dispersed. Hence, it is possible to prevent an increase in the torque, and for example, to reduce the sizes of components.

As is apparent form the foregoing description, the developing container is swingably supported with respect to the developer accommodating container, and the developing container does not include means for stirring and conveying the developer. A plurality of stirring members are provided in the developer accommodating container to which the developing container is connected. The rotational speed of the stirring member closest to the developing sleeve for carrying the developer is set to a highest value, and the radius of the stirring wing closest to the developing sleeve is set to a smallest value. As a result, it is possible to improve the picture quality by improving the circulation of the developer, preventing degradation of the toner, and stably supplying the developer, while realizing an increase in the size of the developer accommodating container.

The individual components shown in outline in the drawings are all well known in the developer accommodating container and developing device arts and their specific construction and operation are not critical to the operation or the best mode for carrying out the invention.

While the present invention has been described with respect to what is presently considered to be the preferred, embodiment, it is to be understood that the invention is not limited to the disclosed embodiment. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A developer accommodating container for accommodating a developer, a developing container where the developer is supplied from said developer accommodating container being swingably connected to said developer accommodating container, said developer accommodating container comprising:

a developer accommodating portion for accommodating the developer; and a plurality of rotatable conveying members, provided in said developer accommodating portion, for conveying the developer, said plurality of conveying members including a first conveying member, provided at a portion closest to said developing container, for conveying the developer to said developing container, wherein said first conveying member out of said plurality of conveying members has a largest angular velocity and a smallest radius of rotation.

2. A developer accommodating container according to claim 1, wherein each of said plurality of conveying members comprises an elastic sheet and a supporting member for supporting said elastic sheet.

3. A developer accommodating container according to claim 2, wherein said elastic sheet is provided in a longitudinal direction of its respective conveying member at a portion of said supporting member having a largest radius of rotation.

4. A developer accommodating container according to claim 1, wherein each of said plurality of conveying members other than said first conveying member has a different phase of rotation.

5. A developer accommodating container for accommodating a developer, a developing container where the developer is supplied from said developer accommodating container being swingably connected to said developer accommodating container, said developer accommodating container comprising:

a developer accommodating portion for accommodating the developer; and a plurality of rotatable conveying members, provided in said developer accommodating portion, for conveying the developer, said plurality of conveying members including a first conveying member, provided at a portion closest to said developing container, for conveying the developer to said developing container, wherein said first conveying member out of said plurality of conveying members has a largest angular velocity and a smallest radius of rotation, and wherein conveying members other than said first conveying member out of said plurality of conveying members have substantially the same angular velocity, and substantially the same radius of rotation.

6. A developer accommodating container according to claim 5, wherein a base surface of said developer accommodating portion includes a plurality of recesses along respective loci of rotation of said plurality of conveying members, and wherein the recesses along the respective loci of rotation of the conveying members other than said first conveying member out of said plurality of conveying members have substantially the same radius of rotation.

7. A developer accommodating container for accommodating a developer, a developing container where the developer is supplied from said developer accommodating container being swingably connected to said developer accommodating container, said developer accommodating container comprising:

a developer accommodating portion for accommodating the developer; and a plurality of rotatable conveying members, provided in said developer accommodating portion, for conveying the developer, said plurality of conveying members including a first conveying member, provided at a portion closest to said developing container, for conveying the developer to said developing container, wherein said first conveying member out of said plurality of conveying members has a largest angular velocity and a smallest radius of rotation, wherein each of said plurality of conveying members comprises an elastic sheet and a supporting member for supporting said elastic sheet, and wherein a thickness of said elastic sheet of said first conveying member is smaller than a thickness of said elastic sheet of a conveying member other than said first conveying member out of said plurality of conveying members.

8. A developer accommodating container according to claim 7, wherein each of the respective elastic sheets of said plurality of conveying members other than said first conveying member has substantially the same thickness.

9. A developer accommodating container according to any one of claims 1 though 7, wherein said developing container comprises a single conveying member for conveying the developer, and wherein said single conveying member is a developer carrying member for carrying the developer, and wherein the developer carrying member develops an electrostatic latent image on an image bearing member by the developer.

10. A developing device comprising:

a developer accommodating container for accommodating a developer; and a developing container where the developer is supplied from said developer accommodating container, said developing container being swingably connected to said developer accommodating container, said developer accommodating container comprising:

a developer accommodating portion for accommodating the developer; and a plurality of rotatable conveying members, provided in said developer accommodating portion, for conveying the developer, said plurality of conveying members including a first conveying member, provided at a portion closest to said developing container, for conveying the developer to said developing container, wherein said first conveying member out of said plurality of conveying members has a largest angular velocity and a smallest radius of rotation.

11. A developing device according to claim 10, wherein each of said plurality of conveying members comprises an elastic sheet and a supporting member for supporting said elastic sheet.

12. A developing device according to claim 11, wherein said elastic sheet is provided in a longitudinal direction of its respective conveying member at a portion of said supporting member having a largest radius of rotation.

13. A developing device according to claim 10, wherein each of said plurality of conveying members other than said first conveying member has a different phase of rotation.

14. A developing device comprising:

a developer accommodating container for accommodating a developer; and a developing container where the developer is supplied from said developer accommodating container, said developing container being swingably connected to said developer accommodating container, said developer accommodating container comprising:

a developer accommodating portion for accommodating the developer; and a plurality of rotatable conveying members, provided in said developer accommodating portion, for conveying the developer, said plurality of conveying members including a first conveying member, provided at a portion closest to said developing container, for conveying the developer to said developing container, wherein said first conveying member out of said plurality of conveying members has a largest angular velocity and a smallest radius of rotation, and wherein conveying members other than said first conveying member out of said plurality of conveying members have substantially the same angular velocity, and substantially the same radius of rotation.

15. A developing device according to claim 14, wherein a base surface of said developer accommodating portion includes a plurality of recesses along respective loci of rotation of said plurality of conveying members, and wherein the recesses along the respective loci of rotation of the conveying members other than said first conveying member out of said plurality of conveying members have substantially the same radius of rotation.

16. A developing device comprising:

a developer accommodating container for accommodating a developer; and a developing container where the developer is supplied from said developer accommodating container, said developing container being swingably connected to said developer accommodating container, said developer accommodating container comprising:

a developer accommodating portion for accommodating the developer; and a plurality of rotatable conveying members, provided in said developer accommodating portion, for conveying the developer, said plurality of conveying members including a first conveying member, provided at a portion closest to said developing container, for conveying the developer to said developing container, wherein said first conveying member out of said plurality of conveying members has a largest angular velocity and a smallest radius of rotation, wherein each of said plurality of conveying members comprises an elastic sheet and a supporting member for supporting said elastic sheet, and wherein a thickness of said elastic sheet of said first conveying member is smaller than a thickness of said elastic sheet of a conveying member other than said first conveying member out of said plurality of conveying members.

17. A developing device according to claim 16, wherein each of the respective elastic sheets of said plurality of conveying members other than said first conveying member has substantially the same thickness.

18. A developing device according to any one of claims 10 through 17, wherein said developing container comprises a single conveying member for conveying the developer, and wherein said single conveying member is a developer carrying member for carrying the developer, and wherein the developer carrying member develops an electrostatic latent image on an image bearing member by the developer.

19. A developing device according to claim 18, wherein the developer carrying member is positioned with respect to the image bearing member.

20. A developing device according to claim 19, wherein said developing device is provided in a process cartridge detachable with respect to an image forming apparatus, together with the image bearing member.

21. A developing device according to claim 18, wherein said developing device is provided in a process cartridge detachable with respect to an image forming apparatus, together with the image bearing member.

22. A developing device according to any one of claims 10 through 17, wherein said developing device is provided in a process cartridge detachable with respect to a main body of an image forming apparatus, together with an image bearing member.

* * * * *

UNITED STATES PATENT AND TRADEMARK OFFICE

CERTIFICATE OF CORRECTION

PATENT NO. : 6,473,585 B2
DATED : October 29, 2002
INVENTOR(S) : Abe et al.

It is certified that error appears in the above-identified patent and that said Letters Patent is hereby corrected as shown below:

Column 1,
Line 32, “severer” should read -- severe --.

Column 2,
Line 30, “m embers” should read -- members --.

Column 4,
Line 48, delete “, and the toner T”
Line 59, “connected” should read -- connected to --.

Column 5,
Line 7, “no” should read -- not --.
Line 15, “do” should read -- does --.
Line 35, “base.” should read -- base --.

Column 7,
Line 15, “form” should read -- from --.
Line 36, “preferred,” should read -- preferred --.

Column 9,
Line 2, “though” should read -- through --.

Signed and Sealed this

Twenty-fourth Day of June, 2003

JAMES E. ROGAN
*Director of the United States Patent and Trademark Office*